US011286739B2

(12) United States Patent
June et al.

(10) Patent No.: US 11,286,739 B2
(45) Date of Patent: Mar. 29, 2022

(54) TUBING HANGER ORIENTATION SYSTEM AND TECHNIQUES

(71) Applicant: OneSubsea IP UK Limited, London (GB)

(72) Inventors: David June, Houston, TX (US); Guy Mosscrop, Cypress, TX (US)

(73) Assignee: ONESUBSEA IP UK LIMITED, London (GB)

( * ) Notice: Subject to any disclaimer, the term of this patent is extended or adjusted under 35 U.S.C. 154(b) by 0 days.

(21) Appl. No.: 15/963,393

(22) Filed: Apr. 26, 2018

(65) Prior Publication Data

US 2018/0320469 A1 Nov. 8, 2018

Related U.S. Application Data

(60) Provisional application No. 62/505,481, filed on May 12, 2017, provisional application No. 62/502,276, filed on May 5, 2017.

(51) Int. Cl.
*E21B 33/038* (2006.01)
*E21B 41/04* (2006.01)
(Continued)

(52) U.S. Cl.
CPC ..... *E21B 33/038* (2013.01); *E21B 23/02* (2013.01); *E21B 33/035* (2013.01);
(Continued)

(58) Field of Classification Search
CPC .. E21B 33/038; E21B 33/035; E21B 33/0415; E21B 33/0422; E21B 23/02; E21B 41/0014; E21B 41/04
(Continued)

(56) References Cited

U.S. PATENT DOCUMENTS

| | | | |
|---|---|---|---|
| 8,151,892 | B2 | 4/2012 | Williams et al. |
| 2003/0146000 | A1 | 8/2003 | Dezen et al. |
| 2015/0259990 | A1 | 9/2015 | June |

FOREIGN PATENT DOCUMENTS

| | | | | |
|---|---|---|---|---|
| WO | 2015135978 | A1 | 9/2015 | |
| WO | 2016022029 | A1 | 2/2016 | |
| WO | WO-2016022029 | A1 * | 2/2016 | ..... E21B 33/035 |

OTHER PUBLICATIONS

Extended European search report issued in European Patent Appl. No. 18169593.3 dated Aug. 31, 2018; 5 pages.

* cited by examiner

*Primary Examiner* — Matthew R Buck
*Assistant Examiner* — Patrick F Lambe
(74) *Attorney, Agent, or Firm* — Eileen Pape

(57) ABSTRACT

A technique is provided for properly orienting a subsea tree with respect to a tubing hanger landed in a subsea wellhead. An alignment ring is rotationally positioned on the subsea wellhead such that a coarse alignment feature of the alignment ring is at a desired angular orientation with respect to a fine alignment feature on the tubing hanger. The alignment ring is then secured to the subsea wellhead. Subsequently, a subsea tree may be rotationally oriented with respect to the tubing hanger as the subsea tree is landed on the subsea wellhead. As the subsea tree engages the coarse alignment feature, the coarse alignment feature guides the subsea tree into engagement with the fine alignment feature of the tubing hanger to ensure proper rotational orientation as landing of the subsea tree is completed.

16 Claims, 7 Drawing Sheets

(51) Int. Cl.

| | |
|---|---|
| ***E21B 33/04*** | (2006.01) |
| ***E21B 41/00*** | (2006.01) |
| ***E21B 23/02*** | (2006.01) |
| ***E21B 33/035*** | (2006.01) |

(52) U.S. Cl.
CPC ..... *E21B 33/0415* (2013.01); *E21B 33/0422* (2013.01); *E21B 41/0014* (2013.01); *E21B 41/04* (2013.01)

(58) Field of Classification Search
USPC ..... 166/341
See application file for complete search history.

TUBING HANGER ORIENTATION SYSTEM AND TECHNIQUES

CROSS-REFERENCE TO RELATED APPLICATION

The present document is based on and claims priority to U.S. Provisional Application Ser. No. 62/502,276, filed May 5, 2017, and U.S. Provisional Application Ser. No. 62/505,481, filed May 12, 2017, which are incorporated herein by reference in their entirety.

BACKGROUND

Subsea installation of a tubing hanger at a wellhead can be a challenging endeavor in terms of reliably attaining proper orientation of the tubing hanger. Due to the substantially matching interface between the tubing hanger and a corresponding Christmas tree, the orientation of the Christmas tree installed at the wellhead and on the tubing hanger is determined by the underlying orientation of the tubing hanger. However, the Christmas tree often also has a narrow range of acceptable orientations based on, for example, external hookups. In various applications, the Christmas tree is oriented in a particular direction to accommodate coupling with external flowlines. Thus, it is important that the initial installation of the tubing hanger be achieved with an orientation suitable for the subsequent Christmas tree installation and orientation.

To ensure proper orientation, a blowout preventer (BOP) used at the wellhead is equipped with a guiding pin. The guiding pin is configured to interface a helix of a tubing hanger running tool as the tubing hanger is delivered and installed in the wellhead. Once the helix is engaged by the pin, the continued interfacing may result in rotating the tubing hanger to a desired orientation. However, the combined use of the guiding pin and helix tends to be highly unreliable and often results in misalignment of the tubing hanger. The misalignment can result from various factors such as: tolerance stack-up errors based on manufacturing tolerances on multiple components; incorrect guiding pin actuations such that the pin does not fully engage the helix; undesirable movement of the tubing hanger running tool helix; and/or simple operator error.

SUMMARY

In general, the present disclosure provides a system and methodology for properly orienting a subsea tree with respect to a tubing hanger landed in a subsea wellhead. An alignment ring is rotationally positioned on the subsea wellhead such that a coarse alignment feature, e.g. an alignment dog, of the alignment ring is at a desired angular orientation with respect to a fine alignment feature on, for example, the tubing hanger. The alignment ring is then secured to the subsea wellhead. Subsequently, a subsea tree may be rotationally oriented with respect to the tubing hanger as the subsea tree is landed on the subsea wellhead. As the subsea tree engages the coarse alignment feature, the coarse alignment feature guides the subsea tree into engagement with the fine alignment feature of the tubing hanger to ensure proper rotational orientation as landing of the subsea tree is completed.

BRIEF DESCRIPTION OF THE DRAWINGS

Certain embodiments will hereafter be described with reference to the accompanying drawings, wherein like reference numerals denote like elements. It should be understood, however, that the accompanying figures illustrate various implementations described herein and are not meant to limit the scope of various technologies described herein, and.

DETAILED DESCRIPTION

Figure 1:
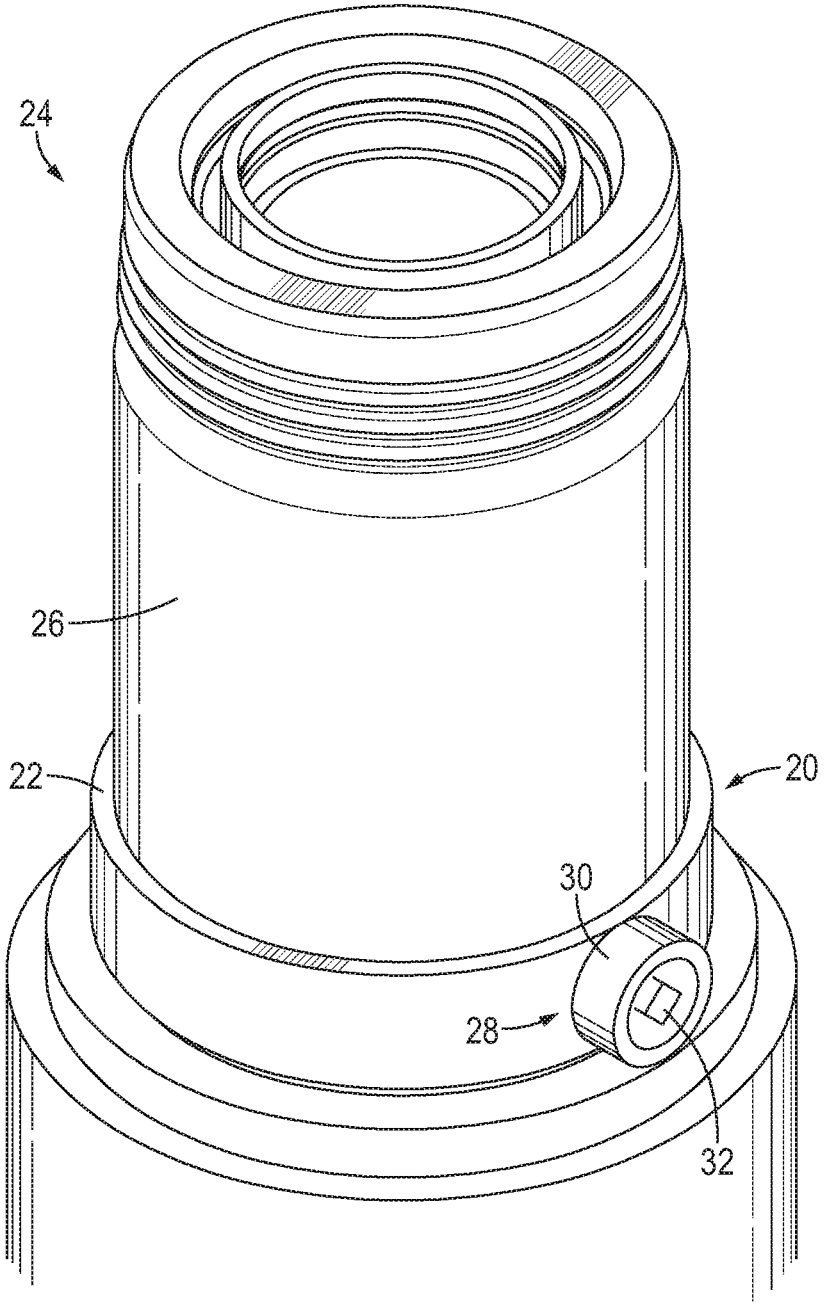
FIG. 1 is a schematic illustration of a subsea well system having a wellhead combined with an example of an alignment ring, according to an embodiment of the disclosure.

In the following description, numerous details are set forth to provide an understanding of some illustrative embodiments of the present disclosure. However, it will be understood by those of ordinary skill in the art that the system and/or methodology may be practiced without these details and that numerous variations or modifications from the described embodiments may be possible.

The disclosure herein generally relates to a system and methodology for properly orienting a subsea tree with respect to a tubing hanger landed in a subsea wellhead. In a variety of subsea operations, the tubing hanger is deployed to the subsea wellhead by a tubing hanger running tool and landed in the subsea wellhead in a desired rotational orientation. A subsea tree, e.g. a Christmas tree, is then rotationally oriented with respect to the tubing hanger to enable proper coupling of various stabs and interacting features between the subsea tree and the tubing hanger.

According to an embodiment, proper positioning of the subsea tree may be facilitated with an alignment ring. For example, an alignment ring may be rotationally positioned on the subsea wellhead such that a coarse alignment feature, e.g. an alignment dog, of the alignment ring is at a desired angular orientation with respect to a fine alignment feature on the tubing hanger. The alignment ring is then secured to the subsea wellhead. The fine alignment feature may be in the form of a groove/recess formed in the tubing hanger or other suitable fine alignment feature positioned for cooperation with the coarse alignment feature.

Subsequently, the subsea tree may be rotationally oriented with respect to the tubing hanger as the subsea tree is landed on the subsea wellhead. For example, as the subsea tree is lowered into position on the wellhead it engages the coarse alignment feature. The coarse alignment feature guides the subsea tree into engagement with the fine alignment feature of the tubing hanger to ensure proper rotational orientation of the subsea tree with respect to the tubing hanger as landing of the subsea tree is completed.

A running tool assembly may be used for installing the tubing hanger. The running tool assembly may comprise a running tool coupled with or comprising an orientation implement, e.g. key, which interfaces with a known location of the tubing hanger during installation of the tubing hanger. The angular orientation of the running tool assembly and thus the tubing hanger may be controlled as a tubing hanger is landed at the subsea well.

In some embodiments, the tubing hanger running tool assembly comprises a gyroscopic heading apparatus to facilitate monitoring of the angular orientation. As the tubing hanger is deployed by the running tool assembly through, for example, a riser, the gyroscopic heading apparatus may be used to determine the orientation of the running tool assembly and thus the tubing hanger. The gyroscopic heading apparatus may be a gyro based device installed in the tubing hanger running tool assembly for communication of orientation/heading data back to the surface in real-time. The data may be communicated to a surface controller via, for example, an in-riser control umbilical. As the tubing hanger is deployed, the orientation of the tubing hanger can be monitored and adjusted via active control from the surface rather than from a passive control at, for example, a blowout preventer (BOP). This technique may be used with a variety of subsea well systems, including a cluster/satellite drill center arrangement. Once the tubing hanger reaches the wellhead, the tubing hanger may be locked and downhole work may be carried out as normal. The BOP and marine riser may be recovered to the surface, leaving the tubing hanger correctly installed and oriented within the wellhead.

The gyroscopic heading apparatus may utilize a gyro which provides relative orientation from a pre-established datum. By way of example, the running tool assembly may be made-up to the tubing hanger on a drill floor and the heading of the tubing hanger may be set to a specific orientation to suit the subsea field layout. The gyroscopic heading apparatus may be calibrated based on this initial heading. As the tubing hanger is run to the subsea wellhead, the heading data may be fed back to the surface in real-time via the running tool umbilical or other communication pathway so that the heading may be adjusted to maintain the desired heading and orientation of the tubing hanger. Landing the tubing hanger at the appropriate orientation ensures that the subsea tree, e.g. Christmas tree, can be set at a desired heading relative to its drill center, e.g. within +/−5° or within tighter tolerances, e.g. within +1-4°.

In addition to eliminating use of a conventional orientation helix, the methodology described herein can be used to eliminate use of a tubing head spool. The technique is very suitable for satellite architecture where the orientation of the Christmas tree is held within predetermined tolerances. The gyroscopic heading apparatus enables landing out of the tubing hanger with the correct heading regardless of depth by providing real-time heading data as the tubing hanger is deployed. In some applications, a remotely operated vehicle (ROV) may be deployed to the wellhead with an ROV verification tool after the BOP and marine riser have been tripped back to the surface. The verification tool may be used to verify the tubing hanger has been oriented at the desired heading.

At this stage, an orientation tool may be used to orient an alignment ring rotationally on the wellhead. The orientation tool is constructed for engagement with the alignment ring which comprises a coarse alignment feature, such as an alignment dog. The orientation tool rotationally orients the alignment feature/alignment dog relative to the known location of the tubing hanger. The alignment ring may then be secured to the subsea wellhead in the desired rotational position.

The subsea tree may then be run to the wellhead in which the tubing hanger has been properly oriented along with the alignment ring. By way of example, the subsea tree may be a Christmas tree and may be run with a gyro device or other suitable orientation device mounted temporarily on the subsea tree frame. The gyro device may be used to help orient the subsea tree for engagement with the alignment ring having the coarse alignment feature. In this example, an alignment system combines the coarse alignment feature and a fine alignment feature. The alignment system provides the final orientation adjustments to ensure the subsea tree is aligned correctly with the tubing hanger. For example, the alignment system may be used to ensure the subsea tree is landed on the tubing hanger at an appropriate orientation so the associated vertical stabs are made up, e.g. connected, without damage. The subsea tree may then be locked in place.

Referring generally to FIG. 1, an alignment system 20 is illustrated as comprising an alignment ring 22. The alignment ring 22 is sized and constructed to be rotatably positioned about a portion of a wellhead 24. In the illustrated example, the alignment ring 22 is rotatably positioned about a pressure housing 26 of the wellhead 24. The pressure housing 26 may be in the form of a high-pressure housing constructed to withstand high pressures encountered in many subsea applications.

The alignment ring 22 comprises a coarse alignment feature 28 which may be in the form of an alignment dog 30 extending radially outward from a remainder of the alignment ring 22. Additionally, the alignment ring 22 may comprise a locking mechanism 32 which is selectively actuatable to lock the alignment ring 22 to the wellhead 24, e.g. to the pressure housing 26. The locking mechanism 32 may be used to lock the alignment ring 22 in position when the coarse alignment feature 28 is located at a desired angular orientation with respect to a tubing hanger, as described in greater detail below. In some embodiments, the locking mechanism 32 may be selectively actuated via an ROV.

Figure 2:
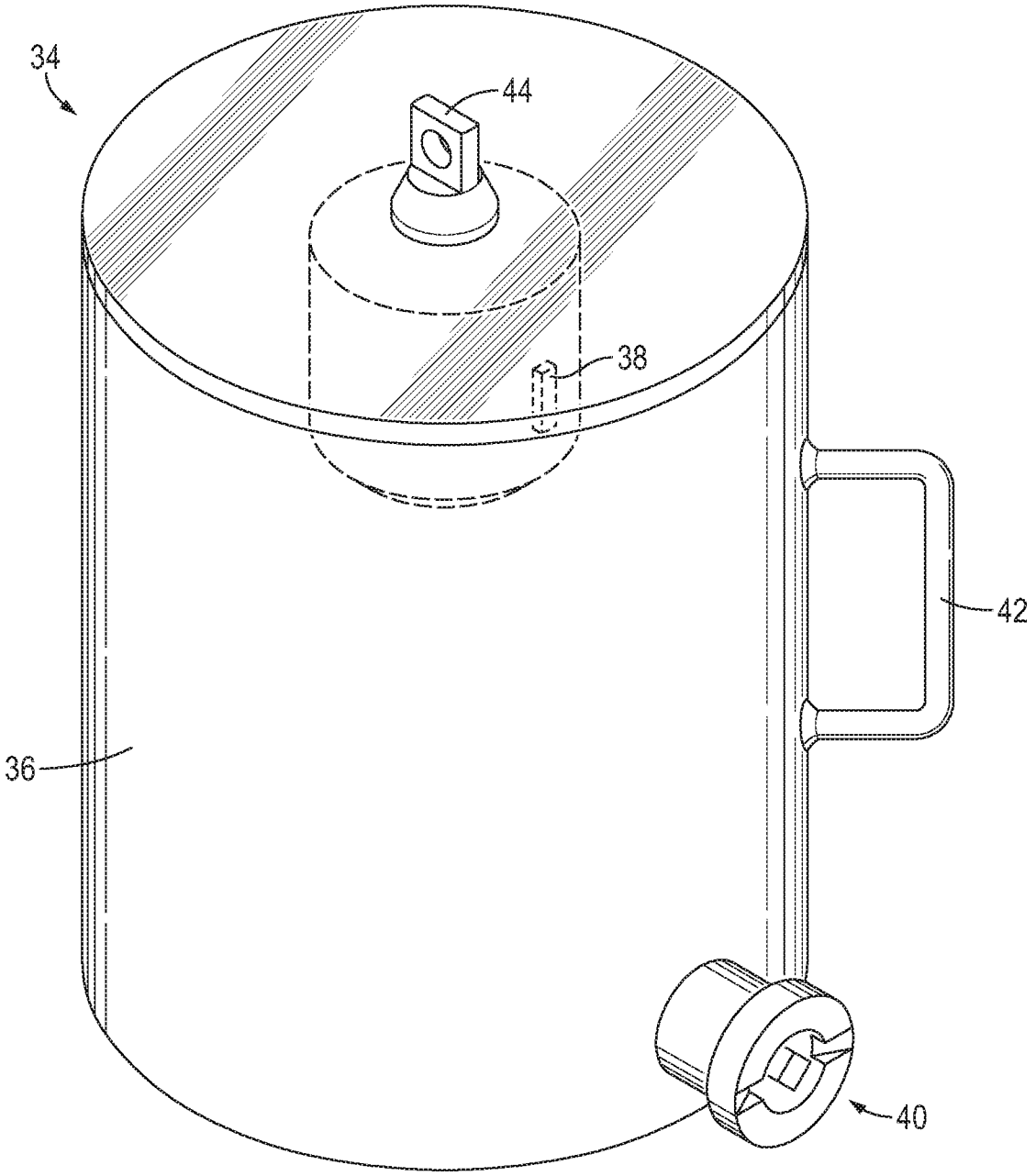
FIG. 2 is a schematic illustration of an example of an orientation tool which may be used to orient an alignment ring, according to an embodiment of the disclosure.

Rotational orientation of the alignment ring 22 on wellhead 24 may be accomplished via an orientation tool 34, an example of which is illustrated in FIG. 2. The orientation tool 34 may be part of various types of running tool assemblies or may be deployed via a cable, ROV, or other suitable conveyance technique. Regardless, the orientation tool 34 may comprise a housing 36 having an internal orientation feature 38 which engages the known location of the tubing hanger so as to ultimately orient the alignment ring 22 in a desired rotational orientation with respect to the tubing hanger. The alignment ring 22 may be deployed with the orientation tool 34 and properly positioned on the wellhead 24 when the orientation feature 38 engages the tubing hanger. However, the alignment ring 22 also may be initially positioned on the wellhead 24 and subsequently oriented via the orientation tool 34.

In some embodiments, the housing 36 may be coupled with an ROV rotary interface 40 which, in turn, engages the locking mechanism 32 of the alignment ring 22 to enable actuation of the locking mechanism 32 via an ROV. Depending on the application, the housing 36 also may be coupled with a gripping fixture 42, e.g. a handle, constructed for engagement by an ROV so the housing 36 may be rotated until the internal orientation feature 38 engages corresponding features at the known location of the tubing hanger. The housing 36 also may comprise an attachment feature 44 configured for coupling with a suitable conveyance, e.g. cable, tubing, ROV bracket, or other deployment system.

Figure 3:
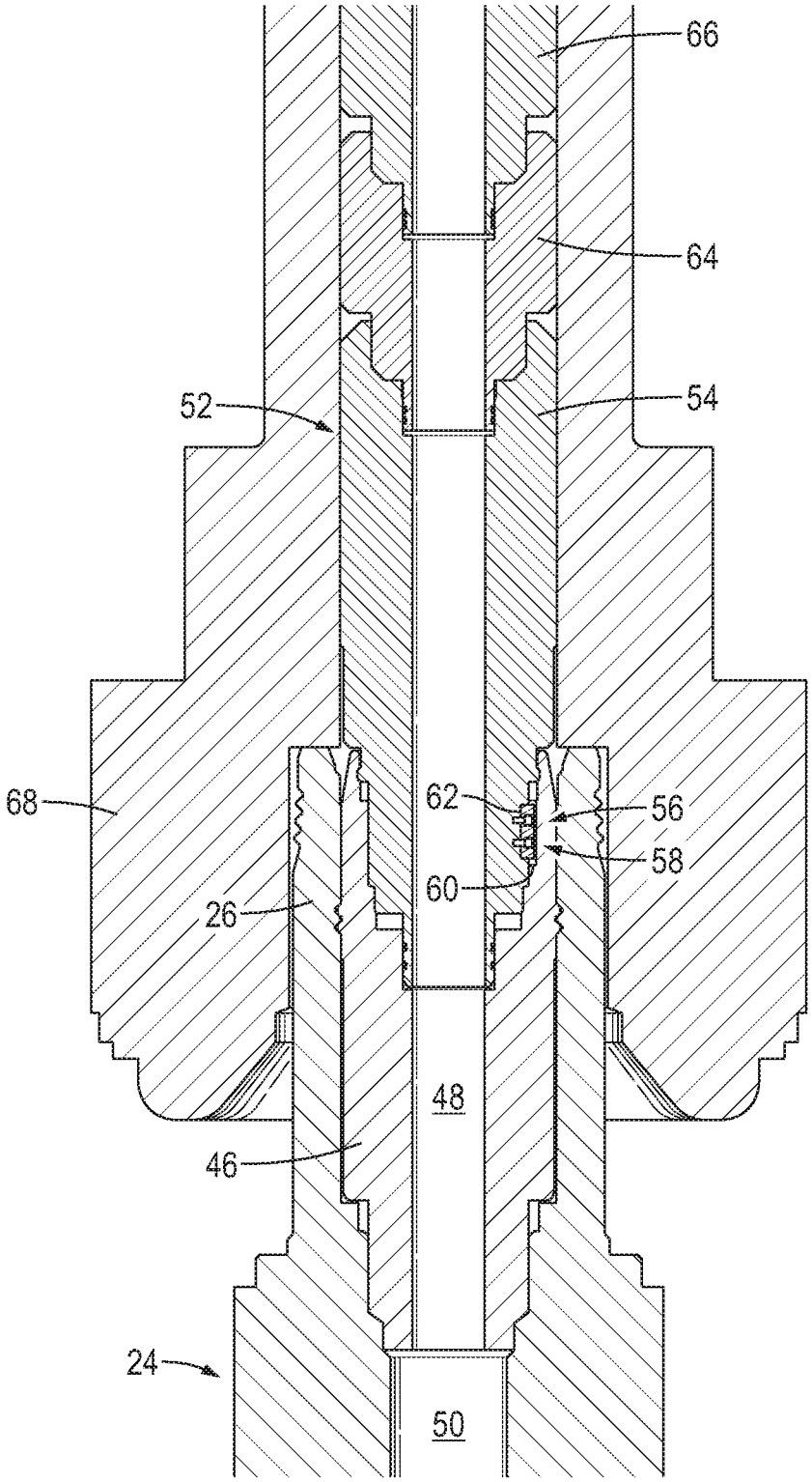
FIG. 3 is a cross-sectional illustration of a subsea well system in which a tubing hanger is positioned in a wellhead, according to an embodiment of the disclosure.

Referring generally to FIG. 3, an illustration is provided showing deployment of a tubing hanger 46 into wellhead 24. In this example, the tubing hanger 46 is landed within high-pressure housing 26 of wellhead 24 such that an internal passage 48 of the tubing hanger 46 is in fluid communication with an internal passage 50 of the wellhead 24. The tubing hanger 46 may be run down to and landed in the wellhead 24 via a tubing hanger running tool assembly 52.

By way of example, the running tool assembly 52 may comprise a tubing hanger running tool 54 releasably secured to the tubing hanger 46 via conventional coupling techniques or other suitable techniques. In this embodiment, the tubing hanger running tool 54 and the tubing hanger running tool assembly 52 are rotationally oriented with respect to a known location 56 of the tubing hanger 46. The known location 56 may comprise a fine alignment feature 58, such as an alignment slot 60. The tubing hanger running tool 54 may include a corresponding orientation implement 62, e.g. a key or other feature, to engage the fine alignment feature 58 at the known location 56. It should be noted the fine alignment feature 58 and coarse alignment feature 28 cooperate to form alignment system 20. The features of alignment system 20 ensure proper positioning of alignment ring 22 and also provide a sequential coarse alignment and subsequent fine alignment of the subsea tree with respect to the tubing hanger 46.

The tubing hanger running tool assembly 52 also may comprise a variety of other features, such as a gyroscopic heading apparatus 64 which provides heading data back to the surface to ensure landing of the tubing hanger 46 in a desired rotational orientation, as described above. Landing the tubing hanger 46 at the appropriate orientation ensures that the subsequently deployed subsea tree, e.g. Christmas tree, can be set at a desired heading relative to its drill center.

Additionally, the tubing hanger running tool assembly 52 may comprise a subsea test tree 66 and/or other components to facilitate running and testing of the tubing hanger 46. In the illustrated example, a BOP stack 68 also is run down to wellhead 24 and landed over the high-pressure housing 26. It should be noted a riser also may extend up to the surface.

Figure 4:
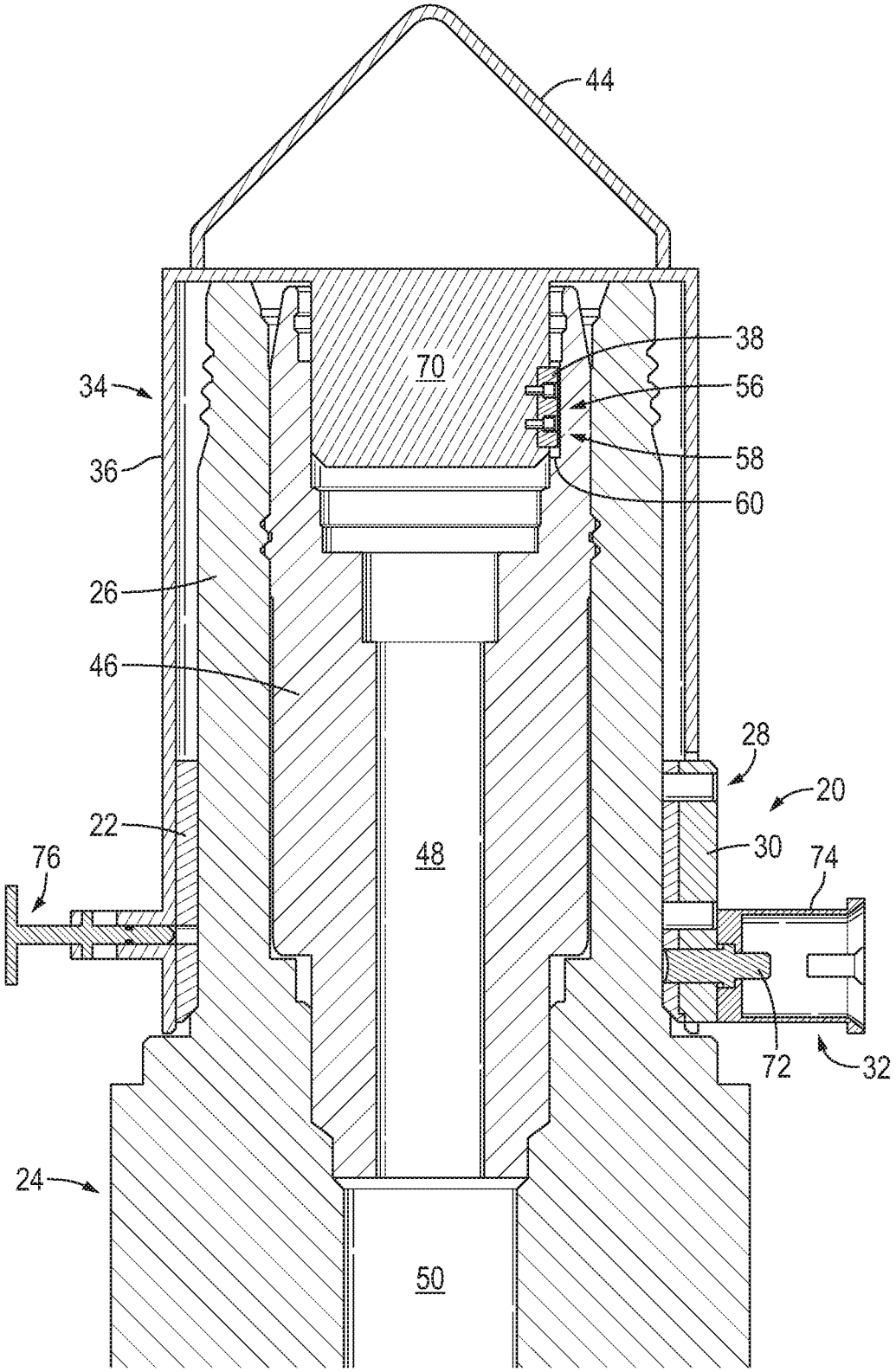
FIG. 4 is a cross-sectional illustration of an example of an orientation tool being used to orient an alignment ring about a pressure housing of a wellhead, according to an embodiment of the disclosure.

After the BOP stack 68 and the tubing hanger running tool assembly 52 are retrieved to the surface, the orientation tool 34 may be deployed over the wellhead 24, e.g. over pressure housing 26, as illustrated in FIG. 4. In this example, the orientation tool 34 comprises internal orientation feature 38 mounted to an internal housing member 70 for engagement with fine alignment feature 58 at the known location 56 of tubing hanger 46. By way of example, the orientation feature 38 may be sized to slide into engagement with alignment slot 60.

The predetermined positioning of orientation tool 34 relative to tubing hanger 46 enables proper positioning of alignment ring 22 and its coarse alignment feature 28. In the example illustrated, the housing 36 of orientation tool 34 fits over pressure housing 26 and may be rotated to move orientation feature 38 into the fine alignment feature 58. For example, the orientation tool 34 may be rotated by an ROV or by other suitable implements or techniques. Additionally, the orientation tool 34 may be lowered into position on wellhead 24 via engagement of attachment feature 44 with an ROV, cable, or other deployment system.

Referring again to FIG. 4, this embodiment of orientation tool 34 is constructed to carry the alignment ring 22 to the desired position about wellhead 24, e.g. about pressure housing 26. For example, the housing 36 of orientation tool 34 may carry the alignment ring 22 within its lower portion and the alignment ring 22 may be secured to the housing 36 via various types of engagement members. Thus, the alignment ring 22 is rotated about the wellhead 24 as the orientation tool 34 is rotated to the desired angular position where feature 38 engages fine alignment feature 58 of the tubing hanger 46. This ensures the coarse alignment feature 28, e.g. alignment dog 30, is positioned at the desired angular orientation with respect to tubing hanger 46. Once properly positioned, locking mechanism 32 may be actuated to lock the alignment ring 22 at this position.

By way of example, the locking mechanism 32 may comprise a threaded member 72 which is selectively threaded into engagement with the wellhead 24 to lock the alignment ring 22 in position. In some embodiments, the threaded member 72 may be coupled with an ROV torque bucket 74 to enable tightening via an ROV. In other embodiments, the locking member 32 may comprise other types of devices, e.g. a latch.

The alignment ring 22 may be releasably secured to orientation tool 34 by suitable mechanisms, such as a shear member or the illustrated engagement member 76. By way of example, the engagement member 76 may comprise a push/pull member, e.g. a spring-loaded pull member, oriented to engage a corresponding feature of alignment ring 22. In other embodiments, the engagement member 76 may comprise various types of releasable members, e.g. a J-slot mechanism or a threaded member which is rotatably mounted in housing 36 and screwed into engagement with the alignment ring 22. After the alignment ring 22 is locked in position on wellhead 24, the engagement member 76 may simply be released, e.g. pulled out of engagement with ring 22, by an ROV or other suitable mechanism to release ring 22 from tool 34.

Figure 5:
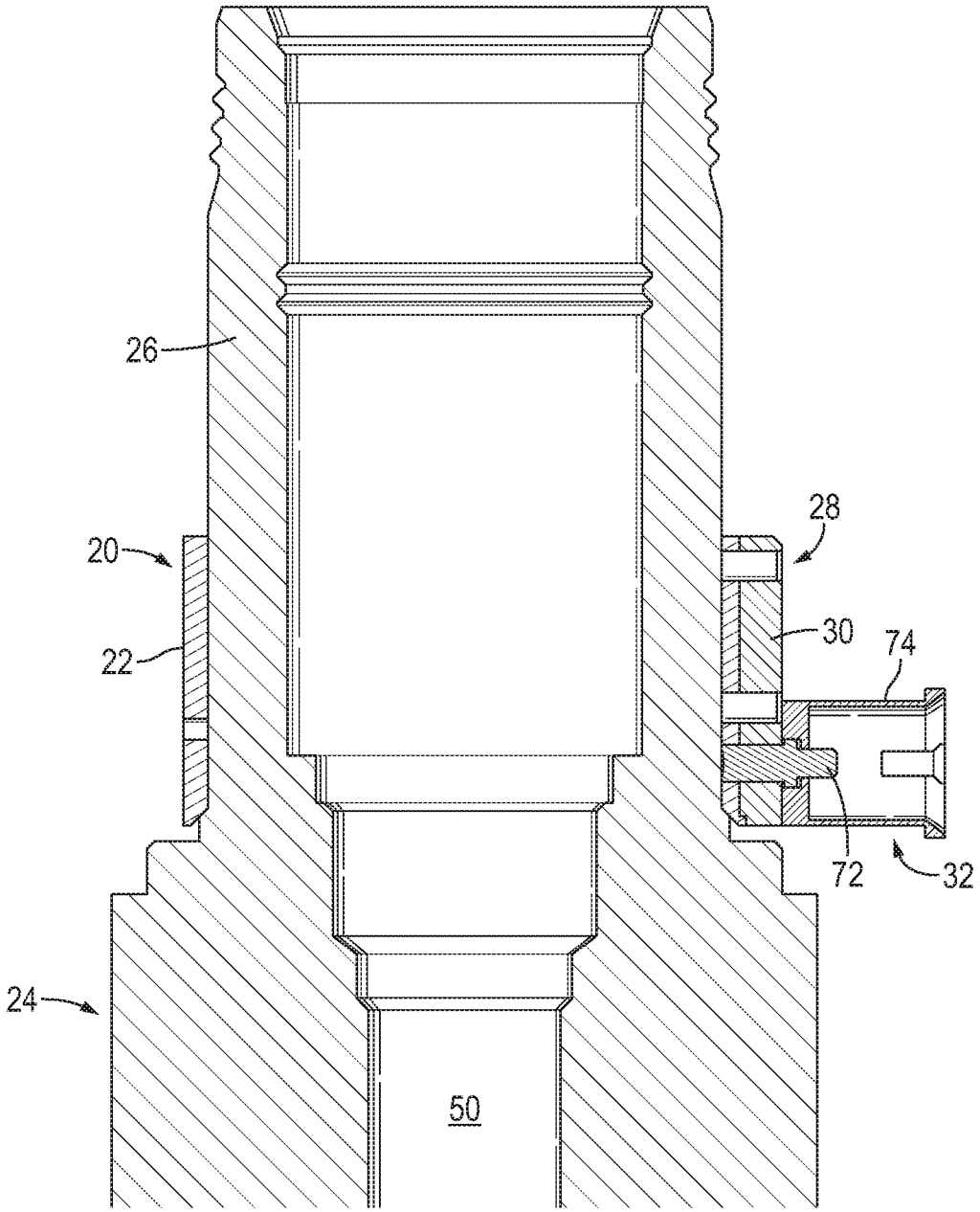
FIG. 5 is a cross-sectional illustration of an example of an alignment ring positioned and oriented about a wellhead, according to an embodiment of the disclosure.

In some embodiments, the alignment ring 22 may initially be positioned on wellhead 24, e.g. on pressure housing 26, as illustrated in FIG. 5. In this type of embodiment, the orientation tool 34 comprises a slot or other mechanism which is moved down into engagement with coarse alignment feature 28 to enable rotation of the alignment ring 22 about the wellhead 24 to the desired angular orientation before locking of the alignment ring 22 to wellhead 24. For example, the orientation tool 34 may be lowered into engagement with alignment dog 30 and then rotated via an ROV or other suitable mechanism until orientation feature 38 engages and slides into slot 60.

Figure 6:
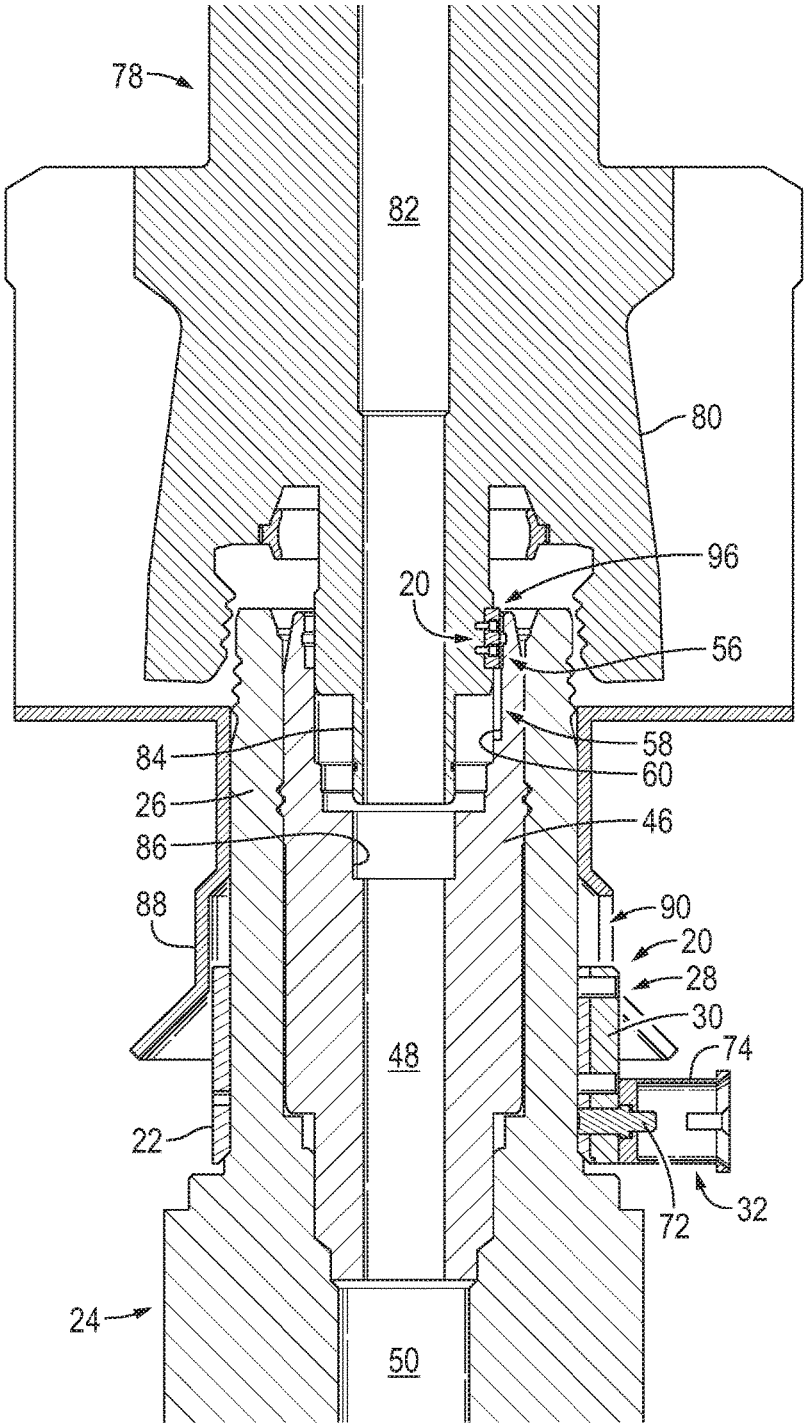
FIG. 6 is a cross-sectional illustration of a subsea tree being landed and oriented with respect to a corresponding tubing hanger and wellhead, according to an embodiment of the disclosure.

Once the alignment ring 22 is properly positioned and locked with respect to wellhead 24, a subsea tree 78, e.g. a Christmas tree, may be run down to wellhead 24 as illustrated in FIG. 6. In this example, the subsea tree 78 comprises a tree body 80 having an internal passage 82. The subsea tree 78 may comprise a plurality of interacting features 84, e.g. stabs, which are rotationally oriented for engagement with corresponding features 86 of tubing hanger 46. To facilitate landing of subsea tree 78, the subsea tree 78 may comprise a tree guide funnel 88 which guides the subsea tree 78 onto wellhead 24 during landing.

Figure 7:
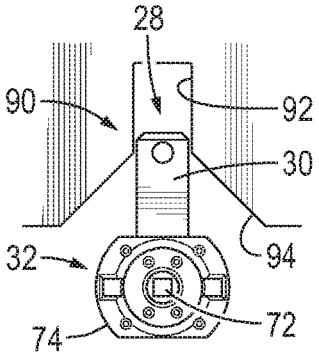
FIG. 7 is a side view showing a portion of the alignment ring with a coarse alignment feature, e.g. alignment dog, combined with a locking mechanism, according to an embodiment of the disclosure.

Additionally, the alignment system 20 rotationally orients the subsea tree 78 with respect to tubing hanger 46 during landing. By way of example, the subsea tree 78, e.g. tree guide funnel 88, may comprise a coarse tree alignment feature 90 which engages the coarse alignment feature 28 of alignment ring 22. As illustrated, the coarse tree alignment feature 90 may comprise a groove 92 having a flared opening 94 as further illustrated in FIG. 7. The coarse alignment features 28, 90 rotationally shift the subsea tree 78 via the sloped surface of flared opening 94, thus positioning the subsea tree 78 to ensure engagement of fine alignment feature 58 with a tree fine alignment feature 96, e.g. a key, of subsea tree 78.

Figure 8:
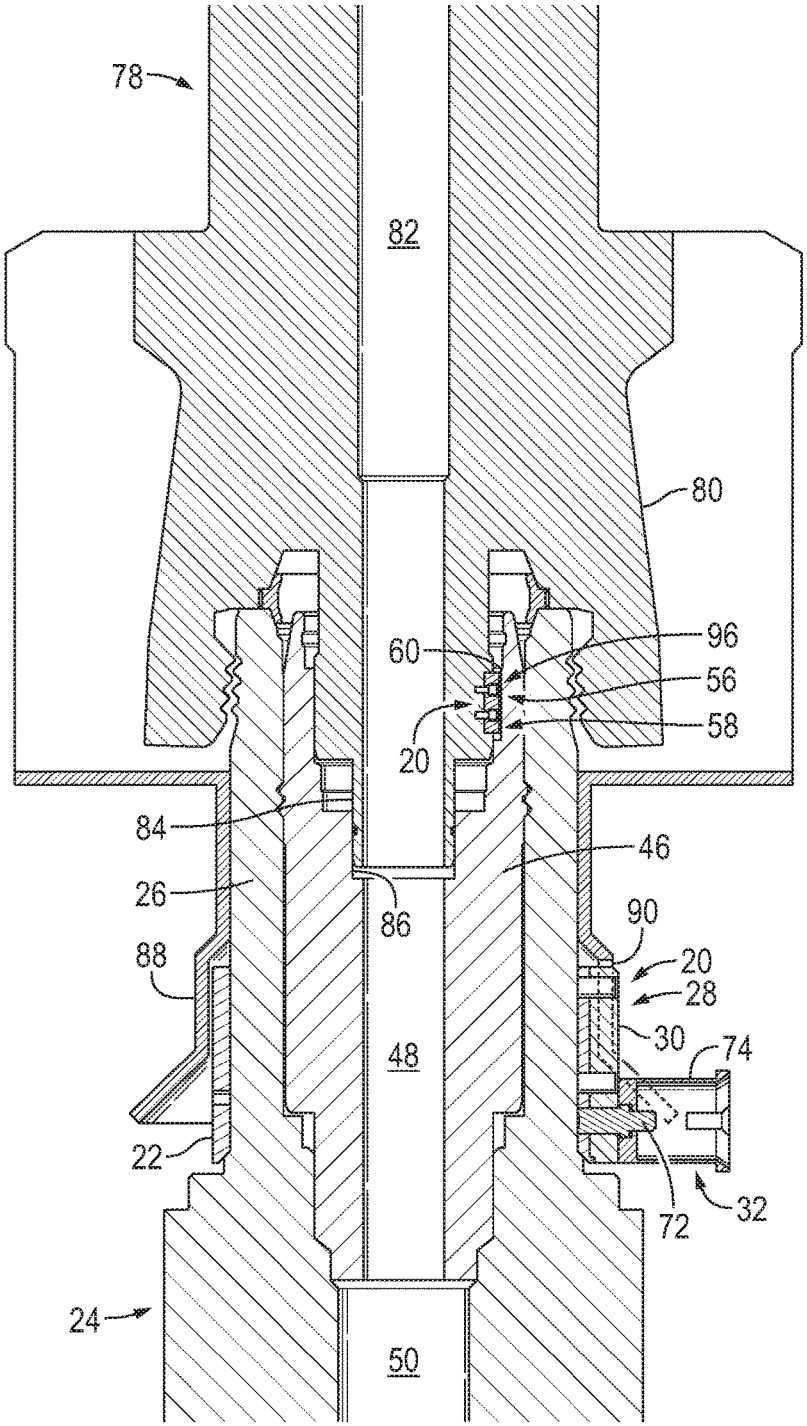
FIG. 8 is a cross-sectional illustration of the subsea tree landed on the wellhead in a proper orientation with respect to the tubing hanger, according to an embodiment of the disclosure.
Figure 9:
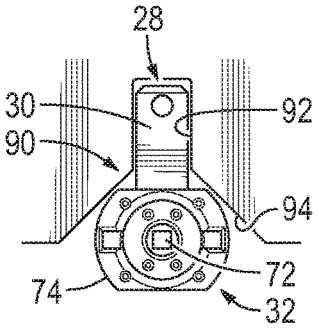
FIG. 9 is a side view showing a portion of the alignment ring with a coarse alignment feature, e.g. alignment dog, combined with a locking mechanism with the subsea tree in the fully landed position, according to an embodiment of the disclosure.

As the subsea tree 78 is moved to the fully landed position illustrated in FIGS. 8 and 9, the fine alignment features 58, 96 more precisely ensure proper rotational positioning of the subsea tree 78. The fine rotation orienting of subsea tree 78 enables proper engagement of subsea tree features 84 with tubing hanger features 86 without damage. For example, the alignment system 20 ensures the subsea tree 78 is landed on the tubing hanger 46 at an appropriate orientation so the associated vertical stabs are made up, e.g. connected, without damage. The subsea tree 78 may then be locked in place on wellhead 24.

According to an operational example, the tubing hanger running tool 54 is used to land the tubing hanger 46 in the subsea wellhead 24. Subsequently, the alignment ring 22 is rotationally positioned on the subsea wellhead 24 via the orientation tool 34. By way of example, the alignment ring 22 may comprise a swage ring or other suitable ring and the coarse alignment feature 28 may comprise alignment dog 30. In this example, the alignment dog 30 is positioned via orientation tool 34 at a desired angular orientation with respect to fine alignment feature 58 of tubing hanger 46. The alignment ring 22 is then locked in place via locking mechanism 32 such that the alignment dog 30 provides a feature for aligning the subsea tree 78 as the subsea tree is landed on the wellhead 24.

During landing of the subsea tree 78, both the coarse alignment feature 28 and the fine alignment feature 58 cooperate sequentially to ensure the subsea tree 78 is properly aligned with the tubing hanger 46. If the water depth is very deep, the alignment system 20 provides assurance that the subsea tree 78 is properly engaged with the tubing hanger 46 without damaging the tubing hanger. The technique described herein enables reliable installation of the tubing hanger 46 with proper orientation followed by installation of the subsea tree 78 at the desired orientation.

Depending on the specifics of a given operation, the wellhead 24, tubing hanger 46, tubing hanger running tool assembly 52, subsea tree 78, and/or other well systems may comprise various components in various configurations to accommodate specific parameters of the given operation. For example, the coarse alignment feature 28 and the fine alignment feature 58 may have various constructions for use with various types of cooperating alignment features. Additionally, the orientation tool 34 may have various components and configurations to accommodate a given wellhead 24, tubing hanger 46, or other system features. The alignment ring 22 also may have various sizes and configurations with various types of alignment features 28 and locking mechanisms 32. The alignment ring 22 may be a solid ring or partial ring depending on the parameters of a given subsea operation.

Although a few embodiments of the system and methodology have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A subsea tree self-orientation system for use in a subsea well, comprising:

a wellhead having a high-pressure housing;

a tubing hanger landed in the high-pressure housing and set to a specific orientation to suit the subsea well;

an orientation tool having an internal orientation feature that engages the specific orientation of the tubing hanger;

an alignment ring rotatably oriented on the high-pressure housing to a desired angular orientation with respect to the specific orientation of the tubing hanger by the orientation tool, the alignment ring comprising a locking mechanism being actuatable to lock the alignment ring to the high-pressure housing when positioned at the desired angular orientation;

an alignment system for rotationally aligning a subsea tree with respect to the tubing hanger, the alignment system comprising:

an alignment dog located on the alignment ring, the alignment dog serving as a coarse alignment feature; and a fine alignment feature located on the tubing hanger, the fine alignment feature being positioned relative to the coarse alignment feature to sequentially provide self coarse alignment and subsequent self fine alignment of the subsea tree while the subsea tree is moving toward a fully landed position on the wellhead.

2. The system as recited in claim 1, wherein the fine alignment feature comprises a tubing hanger slot and wherein the orientation tool further interfaces with the tubing hanger via the tubing hanger slot.

3. The system as recited in claim 2, wherein the subsea tree is oriented with respect to features of the tubing hanger via sliding engagement with the alignment dog and sliding engagement with the tubing hanger slot.

4. The system as recited in claim 1, wherein the alignment ring is rotatably mounted on the high-pressure housing prior to engagement with the orientation tool.

5. The system as recited in claim 1, wherein the alignment ring is transferred from the orientation tool to the high-pressure housing at a subsea location.

6. The system as recited in claim 1, wherein the locking mechanism comprises a threaded member threadably mounted in the alignment ring and oriented to engage the high-pressure housing when rotated.

7. The system as recited in claim 1, wherein the orientation tool comprises an ROV handle to enable gripping and rotation of the orientation tool via a remotely operated vehicle (ROV).

8. A subsea tree self-orientation system, comprising:

a running tool having a tubing hanger tool releasably secured to a tubing hanger set to a specific orientation to suit a subsea well while the tubing hanger is run down and landed in a wellhead, the running tool further having an orientation implement interfacing with a known location of the tubing hanger during run down and installation of the tubing hanger in the wellhead; and an alignment ring rotatably oriented on the tubing hanger to a desired angular orientation with respect to the specific orientation of the tubing hanger, the alignment ring having an alignment dog, the alignment ring sized for securing about the wellhead during installation, such that upon securing the alignment ring, the alignment dog is held at a predetermined position relative to the known location of the tubing hanger;

an alignment system for rotationally aligning a subsea tree with respect to the tubing hanger, the alignment system comprising:

the alignment dog located on the alignment ring, the alignment dog serving as a coarse alignment feature; and a fine alignment feature located on the tubing hanger, the fine alignment feature being positioned relative to the coarse alignment feature to sequentially provide self coarse alignment and subsequent self fine alignment of the subsea tree while the subsea tree is moving toward a fully landed position on the wellhead; and a gyroscopic heading apparatus calibrated to the specific orientation to monitor an angular orientation of the tubing hanger and ensure landing of the tubing hanger in the specific orientation.

9. The system as recited in claim 8, further comprising the tubing hanger landed in a pressure housing of the wellhead, the fine alignment feature comprising an orientation slot positioned for engagement with an orientation tool.

10. The system as recited in claim 9, wherein the alignment ring comprises an adjustable locking mechanism to lock the alignment ring at the desired angular position with respect to the wellhead.

11. The system as recited in claim 10, wherein the adjustable locking mechanism comprises a threaded member threadably mounted in the alignment ring and oriented to engage the pressure housing when rotated.

12. The system as recited in claim 9, wherein the alignment ring is rotatably mounted on the pressure housing.

13. The system as recited in claim 9, wherein the alignment ring is transferred from the orientation tool to the pressure housing at a subsea location.

14. A method to self-orient a subsea tree, comprising:

landing a tubing hanger set to a specific orientation to suit a subsea well in a subsea wellhead;

rotationally positioning an alignment ring on the subsea wellhead such that an alignment dog of the alignment ring is at a desired angular orientation with respect to an alignment feature on the tubing hanger;

securing the alignment ring to the subsea wellhead; and guiding a subsea tree toward a fully landed position with respect to the subsea wellhead by first engaging the subsea tree with the alignment dog and subsequently engaging the subsea tree with the alignment feature of the tubing hanger;

wherein engagement of the subsea tree with the alignment dog and the alignment feature during movement of the subsea tree orients the subsea tree.

15. The method as recited in claim 14, wherein rotationally positioning comprises using an orientation tool to rotate the alignment ring to a desired angular position on the wellhead.

16. The method as recited in claim 14, wherein securing comprises actuating a locking mechanism on the alignment ring.

* * * * *